US005925845A

United States Patent [19]

Tompkins et al.

[11] Patent Number: 5,925,845

[45] Date of Patent: Jul. 20, 1999

[54] SHOOT-THROUGH COVER FOR AN EXPLOSIVELY FORMED PENETRATOR WARHEAD

[75] Inventors: Robert E. Tompkins, Plymouth; Erling M. Danielson, Coon Rapids, both of Minn.

[73] Assignee: Alliant Techsystems Inc., Hopkins, Minn.

[21] Appl. No.: 08/905,174

[22] Filed: Aug. 1, 1997

[51] Int. Cl.[6] ..... F42B 12/10

[52] U.S. Cl. ..... 102/476; 102/293; 102/501; 114/20.1

[58] Field of Search ..... 102/293, 305–310, 102/383, 393, 399, 475, 476, 480, 489, 501; 114/20.1

[56] References Cited

U.S. PATENT DOCUMENTS

| | | | |
|---|---|---|---|
| 4,693,181 | 9/1987 | Dadley et al. | 102/308 |
| 4,982,667 | 1/1991 | Weimann | 102/306 |
| 5,151,558 | 9/1992 | Rudolf et al. | 102/476 |
| 5,365,852 | 11/1994 | Bender et al. | 102/476 |

FOREIGN PATENT DOCUMENTS

| | | | |
|---|---|---|---|
| 3830527 | 3/1990 | Germany | 102/501 |
| 3920017 | 1/1991 | Germany | 102/476 |
| 2214618 | 9/1989 | United Kingdom | 102/476 |

*Primary Examiner*—Harold J. Tudor
*Attorney, Agent, or Firm*—George A. Leone; Mark Goldberg

[57] ABSTRACT

An improved shoot-through warhead cover is constructed of a low density material, such as polyethylene foam, in a dome-like shape. An anterior surface of the shoot-through cover is configured so as to be in proximate mating relationship with the exterior surface of an EFP liner member. The exterior surface of the cover is also aerodynamically contoured to match the external shape of a receiving warhead delivery vehicle body.

19 Claims, 5 Drawing Sheets

SHOOT-THROUGH COVER FOR AN EXPLOSIVELY FORMED PENETRATOR WARHEAD

U.S. GOVERNMENT RIGHTS

The United States Government has certain rights to this invention under government contract number F08630-93C-0014.

FIELD OF THE INVENTION

The present invention is generally related to a warhead delivery system, and more specifically to explosively-formed penetrator (EFP) warheads, and more particularly to a cover for an aerostable explosively-formed penetrator warhead.

BACKGROUND OF THE INVENTION

In military ordnance arts, destructive devices known as warhead delivery systems, and commonly referred to as simply "warheads," have been developed to accomplish a wide variety of military mission requirements.

A warhead generally refers to a combination of components including, among others, a projectile designed to destroy a target upon impact, an explosive material or charge, a firing means or explosive mechanism intended to detonate the explosive charge and thereby forcibly propel or launch the projectile toward a target, a warhead housing by which the projectile and explosive charge are self contained before firing, and a launch tube for generally holding the warhead housing or canister. A delivery vehicle commonly carries the warhead to an area near or over the target.

The projectiles of the warhead may be of several types including, among others, explosive projectiles containing an explosive charge that detonates upon impact with a target, and explosively formed penetrator (EFP) warheads having warhead kill mechanisms in the form of, for example, multiple fragments, a stretched rod EFP, and an aerostable EFP. A multiple fragment EFP warhead consists of multiple and relatively small individual projectiles fired concurrently from a warhead, and is particularly suited for destruction in shotgun-like fashion of multiple targets in proximity to each other, such as enemy missiles housed on a launch platform. A stretched rod EFP and an aerostable EFP type of warhead are particularly suited for destruction of single targets that have substantial defensive capability, e.g., enemy tanks with heavy armor plating. This is so since a stretched rod or aerostable EFP is a singular projectile warhead capable of piercing through such plating.

An aerostable EFP, specifically, is a projectile that is explosively formed from a generally preformed disk-shaped member, commonly referred to as the liner. The liner is adapted to conform to the lateral cross section of a housing or canister, and also serves as an end cap for the explosive charge within the housing. Immediately after firing, however, the liner is advantageously deformed by a shock wave or expanding combustion gas impact of the detonated explosive charge within the housing, and, in turn, the liner becomes relatively axially elongated as it exits the housing. The elongation becomes conical in appearance as particularly illustrated in FIG. 9. That is, the resulting aerostable EFP projectile progressively has a widening diameter from its forward or nose end to its rearward or tail end. Such post-firing conical shaping is advantageous because the aerostable EFP projectile becomes relatively aerodynamically stable, as its name implies, and is constructed to have flight characteristics similar to that of a rifle bullet.

EFP warhead delivery systems are generally secured in place in a launch tube of a the warhead delivery vehicle such that the exit end of the warhead housing and launch tube, i.e., the end where the EFP projectile exits, is generally very proximate to a projectile exit aperture in the outer skin surface of the warhead delivery vehicle. However, warhead delivery systems are generally required to survive in hostile environments, and be capable of performing their destructive mission roles completely and with a high degree of accuracy. To this end, warheads carried aboard delivery vehicles, such as cruise missiles and the like, are designed to be sheltered or protected from detection and destruction by enemy defense systems.

Accordingly, integration of the EFP warhead into the warhead delivery vehicle often requires that the warhead shoot through an aerodynamic warhead covering device. The covering device is commonly configured to fill the projectile exit aperture and have an outer surface that conforms to the outer skin surface of the delivery vehicle. This is so that the aerodynamic stability of the warhead delivery vehicle is maintained, and secondarily diminishes detection by the enemy defense systems. These EFP warhead covering devices are commonly referred to as shoot-through aerodynamic covers. They have often been constructed of a rigid material, such as a frangible plastic material or the like, that has an adverse affect on the EFP projectile formation as the liner impacts the cover as will be described in further detail below.

In use, a selected EFP warhead projectile (for example, a single stretched rod EFP or aerostable EFP) is fired or shot from the associated housing, and breaks through the shoot-through cover that had been protecting it. The shoot-through cover is designed to readily break apart upon impact by the projectile as the projectile exits the housing. Unfortunately, however, the shoot-through cover often degrades the intended EFP projectile's shape formation and performance as compared to the shape formation without shooting through the shoot-through cover. This is thought to be caused by random fracturing of the EFP "first formed" or "forming" projectile as it impacts the cover and passes therethrough. This is due, in part, to a loss of momentum experienced by the projectile immediately after firing when it contacts the cover, and to aerodynamic instability as the impact of the projectile with the cover displaces the resulting projectile from its intended flight path.

In the case of an aerostable EFP, for example, the impact of the first formed or "forming" projectile onto the cover commonly causes the resulting or exiting EFP projectile to exhibit aerodynamic stability degradation, and may also degrade the intended flight path. Furthermore, as is the case for an aerostable EFP, the resulting projectile is designed to develop fins at its rearward end due to liner deformation through combustion gas impact, after becoming conically elongated, as aforementioned. As will be appreciated by those skilled in the art, the fins function much like fixed stabilizing control surfaces on the delivery vehicle to provide aerodynamic stability. However, it has been observed that shoot-through covers of the prior art detrimentally disrupt the fin formation because of the impact of the first formed projectile with the cover. This is illustrated in FIG. 9 by the rough or jagged peripheral end of the aft section of the projectile.

In order to obviate the detrimental effects of the so called shoot-through covering devices, some warhead covers are first destroyed by a pyrotechnic device just before the warhead is detonated, and the EFP projectile passes through the projectile exit aperture. Unfortunately, such pre-removal covering devices generally add significant complexity and cost to the warhead vehicle delivery system.

Consequently, there is a need for a shoot-through cover that tends not to degrade the aerodynamic stability of the aerostable EFP projectile, and that does not add complexity and cost to the warhead. Furthermore, there is a need for a shoot-through cover that may positively affect the resulting EFP projectile formation.

SUMMARY OF THE INVENTION

In accordance with the present invention, an improved shoot-through warhead cover is constructed of a low density material, such as polyethylene foam, in a-dome-like shape having mass symmetry. An anterior surface of the shoot-through cover is configured so as to be in a proximate mating relationship with the exterior surface of the EFP liner member. The exterior surface of the cover is also aerodynamically contoured to match the external shape of a receiving delivery vehicle body.

In another embodiment of the invention, the cover may advantageously be constructed so as to exhibit a non-uniform mass profile while maintaining mass symmetry, where the cover includes a plurality of radial portions having a higher mass density than other portions thereof, and wherein the plurality of radial portions are substantially equally angularly displaced about a central cover axis so as to enhance formation of fins onto the emerging EFP projectile passing through the cover.

It is an object of the present invention to provide an improved shoot-through warhead cover for an aerostable EFP.

It is another object of the present invention to provide an improved shoot-through warhead cover that tends to enhance aerodynamic fin formation of the EFP projectile.

It is another object of the present invention to provide a shoot-through warhead cover that enhances fin like formation of the aft section of the EFP projectile.

Yet another object of the invention is to provide an EFP projectile having masssymmetry.

Other objects, feature and advantages of the present invention will become apparent to those skilled in the art through the description of the preferred embodiment, claims and drawings wherein like numerals refer to like elements.

DETAILED DESCRIPTION OF THE INVENTION

Figure 1:
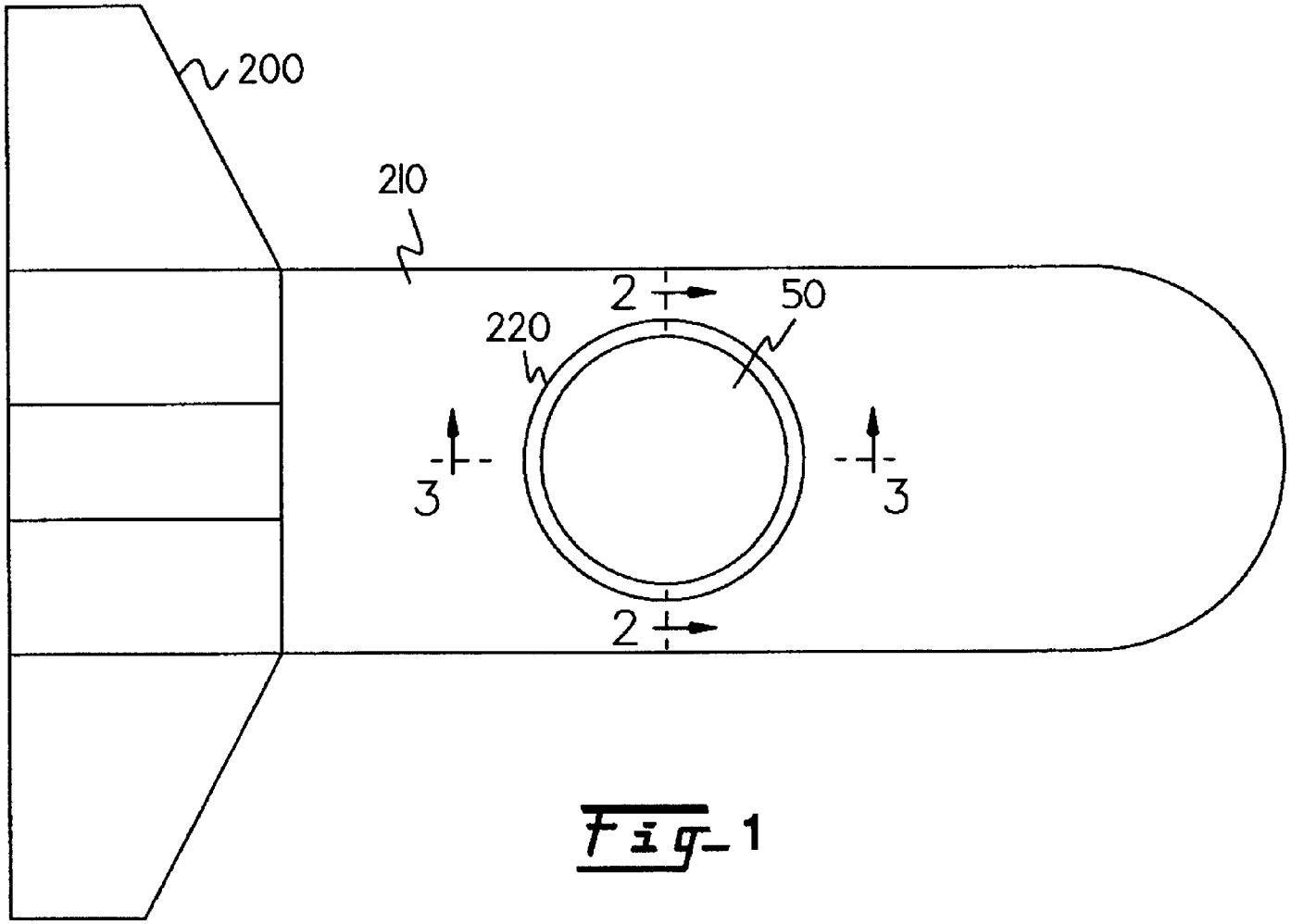
FIG. 1 is a representation of a plan view of a warhead delivery vehicle incorporating a shoot-through cover.

FIG. 1 is a representation of a plan view of a warhead delivery vehicle 200 incorporating a shoot-through cover 50 in accordance with the present invention. As will be more fully described with reference to FIGS. 2 and 3, warhead delivery vehicle 200 is constructed to carry a warhead 100 (FIG. 2) secured in place, by conventional means (not shown). Delivery vehicle 200 may be, for example, a cruise missile. Another example of a delivery vehicle 200 is one referred to as a Low Cost Anti-Armor Submunition (LOCAAS) developed by Loral Vought Systems. A LOCAAS delivery vehicle 200 provides seeker/sensor and airframe technology to autonomously detect, acquire, and classify targets according to target type. Warhead delivery vehicle 200 includes an outer body surface 210 having a combination warhead housing receiving aperture and projectile exit aperture generally depicted by numeral 220.

Figure 3:
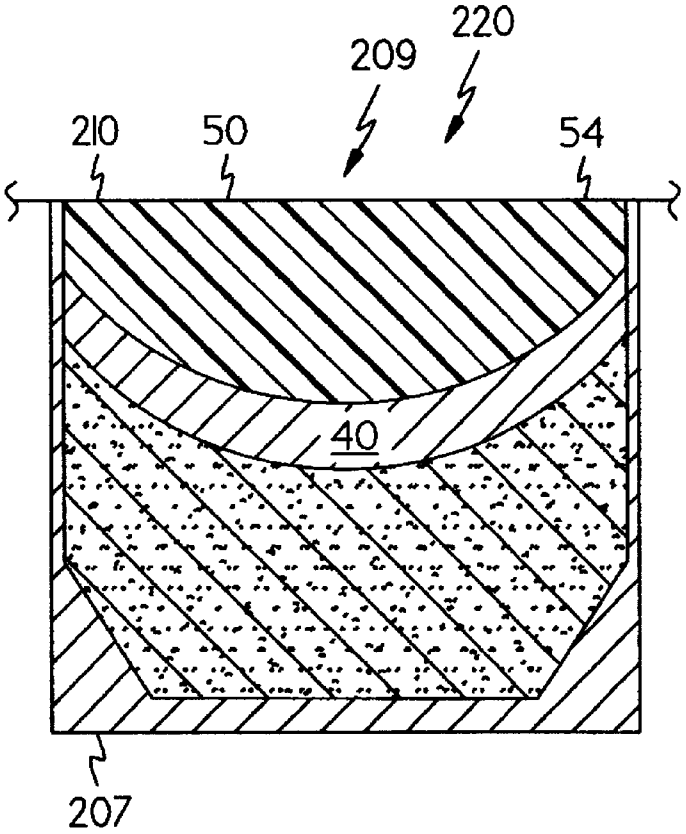
FIG. 3 is a partial cross-sectional view of an EFP warhead and shoot-through cover of the present invention along section lines 3—3 of FIG. 1.
Figure 2:
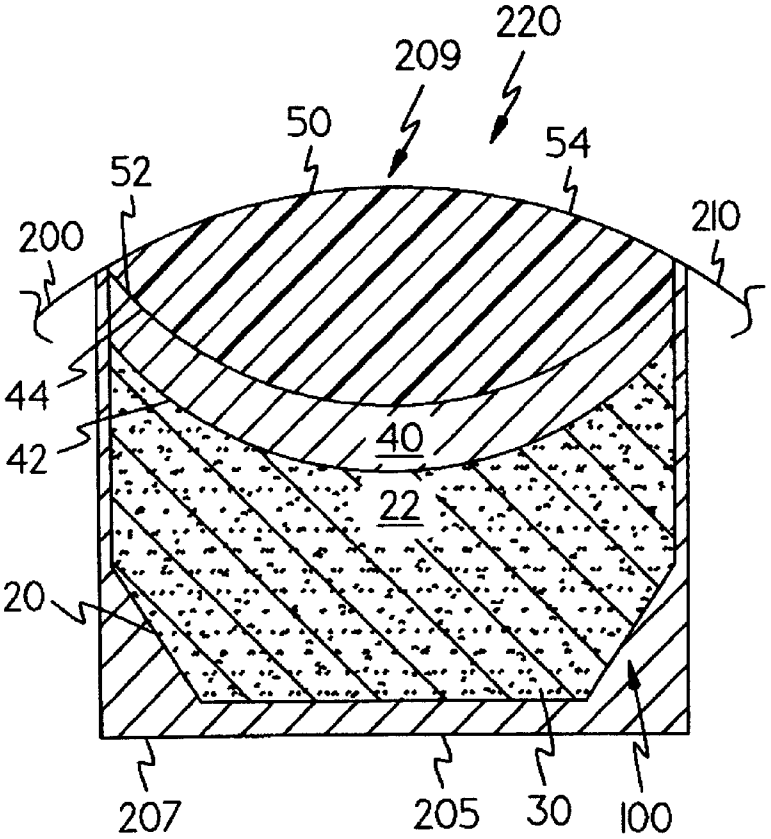
FIG. 2 is a partial cross-sectional view of an EFP warhead and shoot-through cover of the present invention along section lines 2—2 of FIG. 1.

Referring now to FIGS. 2 and 3, thereshown are partial cross-sectional views of warhead 100 secured in place to warhead delivery vehicle 200 along detail section lines 2—2 and 3—3, respectively. Within the interior of warhead delivery vehicle 200 and affixed thereto is a generally cylindrical canister or launch tube 205 having an inward end 207 and an exit port 209 centrally aligned with projectile exit aperture 220 of outer skin surface 220 of vehicle 200. Launch tube 205 is geometrically configured to receive a pre-launch aerostable EFP warhead generally indicated by numeral 100 similar to those manufactured by Alliant Techsystems, Hopkins, Minn., in accordance with "Anti-Material Submunition Warhead Technology (AWST)" as described in a product brochure identified as 16247 8/95.

EFP warhead 100 generally includes a cylindrically shaped housing 20, explosive charge 30, and preformed disk shaped member 40 commonly referred to as a liner. Housing 20 serves as an EFP projectile forming chamber for producing an explosively formed aerostable EFP projectile that is intended to be solely constructed from liner 40 in a manner as is well known in the art.

Liner 40 is illustrated in FIG. 2 as having inner and outer opposed surfaces 42 and 44, respectively. Liner 40 is suitably constructed to be press fit into place through an open end 22 of housing 20. Liner 40 serves as an "explosive end cap" by which explosive charge 30 is held in place and sealed within housing 20 by inner surface 42 of liner 40 and the peripheral surfaces thereof. As depicted in FIGS. 2 and 3, liner 40 is generally conically shaped having the convex side thereof, namely surface 42, in direct proximity to explosive charge 30. Liner 40 is typically constructed of soft metallic material, such as a copper based material, and housing 20 is generally constructed of a high-strength light weight material such as aluminum, as is commonly known in the art.

Explosive charge 30 is constructed to be detonated by a suitable conventional firing or detonating mechanism (not shown). Explosive charge 30 may advantageously be selected so as to be sufficient to both form the EFP projectile as well as propel the projectile with sufficient velocity so as to serve as the kill mechanism. One example of explosive charge 30 commonly employed in EFP warheads is a well known high-energy and reduced sensitivity plastic bonded explosive PBXN-9.

Again referring to FIG. 2, in accordance with the present invention, thereshown is a generally circular and solid "dome-shaped" shoot-through cover 50 including a generally convex surface 52, and a second generally convex surface 54, opposite the convex surface 52. Convex surface 52 of cover 50 is configured so as to be in proximate mating relationship with the exterior surface 44 of liner 40. In the preferred embodiment of the invention the proximate mating relationship is such that convex surface 52 of cover 50 is in intimate contact with exterior surface 44 of liner 40.

As illustrated in both FIGS. 1 and 2, a cover 50 is inserted in projectile exit aperture 220 and includes an outer surface 54 configured to minimize aerodynamic disruption of fluid flow along outer body surface 210, when the vehicle 200 is in flight. More specifically, the outer surface 54 is formed to substantially match the cylindrical contour of outer skin surface 210 of vehicle 200 so as to minimize any discontinuities in the outer surface 210 of vehicle body 200 when the cover 50 is in place within projectile exit aperture 220.

Figure 8:
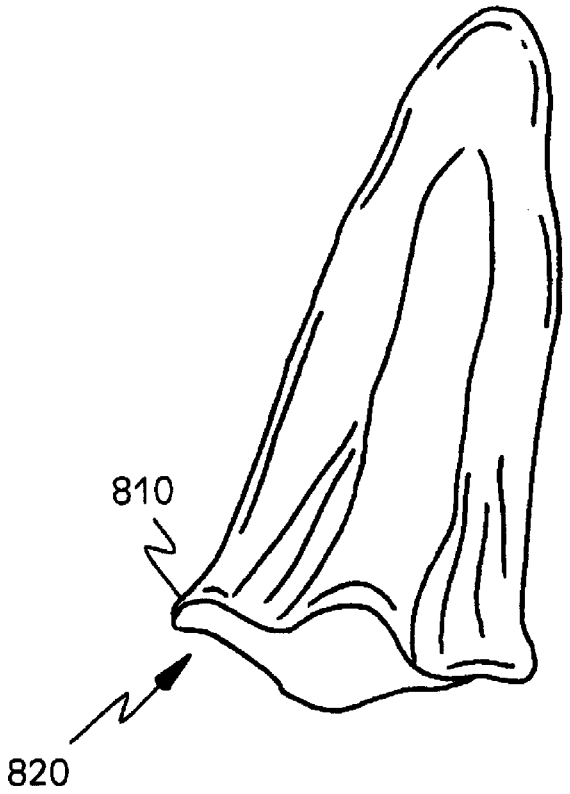
FIG. 8 is an isometric sketch depicting an aerostable EFP projectile having passed through a shoot-through warhead cover in accordance with present invention.

In a typical mission, warhead delivery vehicle 200 is deployed from a weapon dispenser (not pictured) and flies to a target area. After flying to the target area, the warhead delivery vehicle 200 will search, detect, and attack, through warhead 100 deployment, a selected target. Deployment of the warhead 100 is built by the following steps. First, the explosive 30 is detonated by a firing mechanism (not shown). Second, the detonation of the explosive charge 30 causes deformation of liner 40, as aforedescribed, and propels outward from housing 20. Propulsion forward of liner 40 caused by the combustion gases of explosive charge 30 results in liner 40 becoming a somewhat slender and conically shaped projectile as has been described above for forming the well known EFP projectile as is depicted in FIG. 8, and more specifically the aerostable EFP warhead projectile. During this deformation and conical shaping of liner 40, liner 40 continues to be propelled toward and through cover 50.

In the preferred embodiment of the invention, cover 50 is constructed of a low density material in which surface 52 is in intimate contact with the free surface of the liner, namely outer surface 44 of liner 40, and the outer surface 54 is contoured to conform with the aerodynamic outer skin surface 210 of warhead delivery vehicle 200. In the preferred embodiment invention, the cover is constructed of a polymer foam, for example, polyethylene foam. Other types of equivalent low density material may be substituted.

Figure 4:
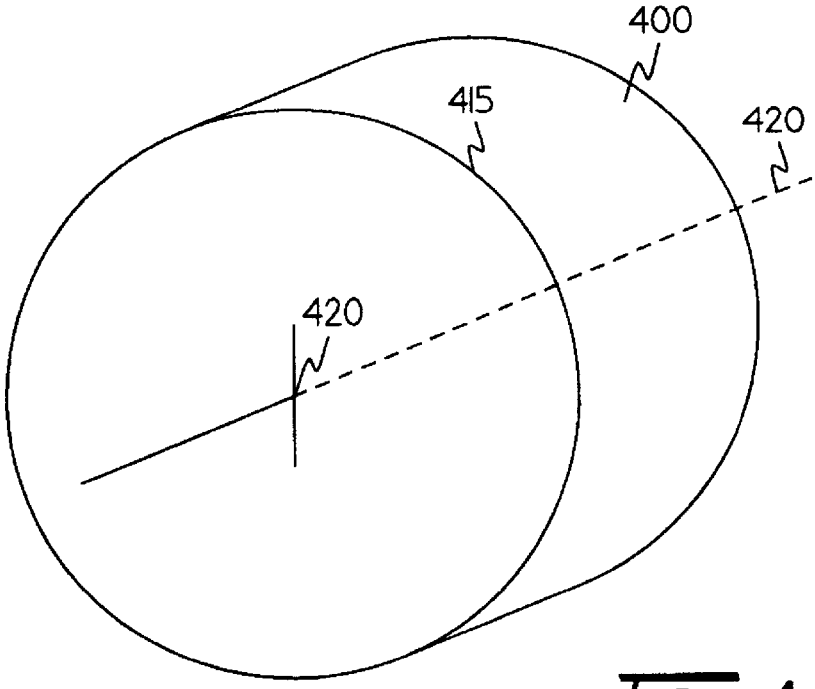
FIG. 4 is a perspective of a base for forming a cover in accordance with the present invention.

In accordance with the present invention, cover 50 is constructed to have a selected mass and mass symmetry while being dimensionally asymmetric. FIGS. 4, 5, and 6*a*–6*c* illustrate components employed in the construction of a shoot-through cover in accordance with the present invention. As illustrated in FIG. 4, one method of constructing a cover 50 in accordance with the present invention starts with a base 400 of polyethylene foam in the form of an 8 inch diameter right circular cylinder. Base 400 is then heated and compressed into a mold by using an arbor press to form cover 50 with mass symmetry in accordance with the present invention as is particularly illustrated in FIGS. 2 and 3.

Figure 5:
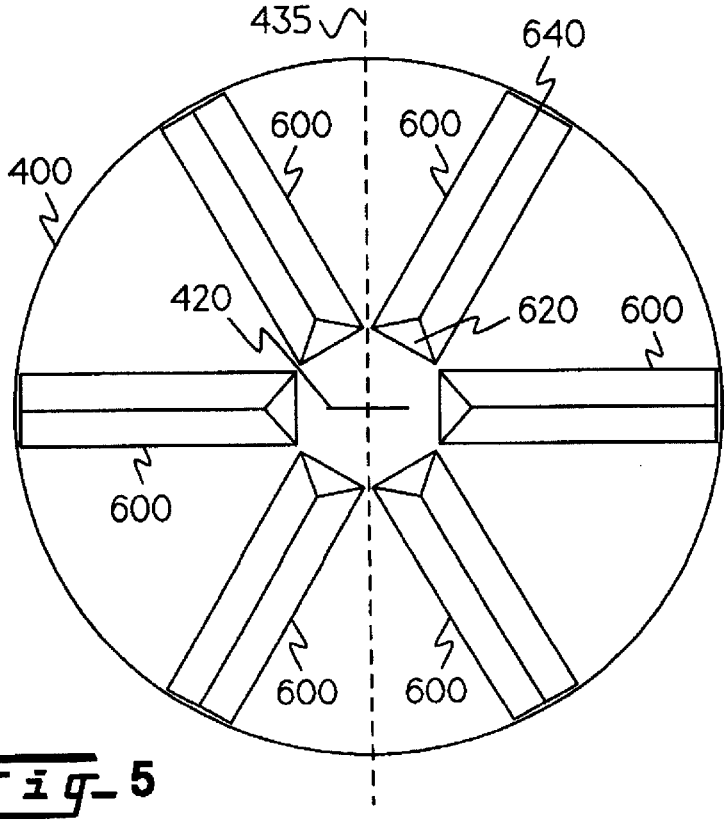
FIG. 5 is a plan view of a base and wedges for forming a cover in accordance with the present invention.

In an alternative embodiment of the present invention as particularly illustrated in FIG. 5, cover 50 is constructed to have a non-uniform mass profile about the central axis 420 of cover 50 where there exist radial portions of cover 50 that have a higher density than other portions thereof, and that are substantially equally angularly displaced about the central axis 420 thereof. In one form of the present invention, the increased mass radial portions are symmetrically located about the central axis 420 of cover 50 as will be further explained. A cover having these characteristics as just described may be made by employment of additional polymer foam wedges or pieces that are first affixed to the base 400 before being heated and compressed to obtain the desired geometric configuration.

Figure 6A:
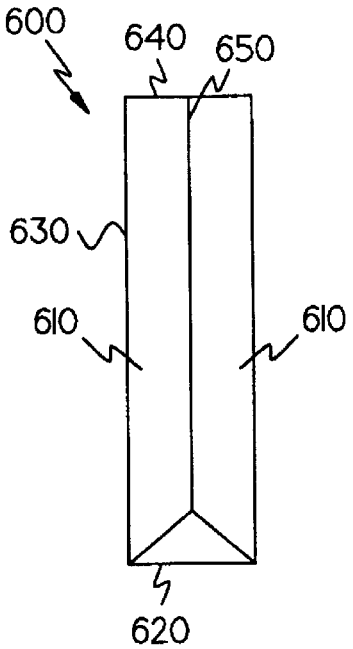
FIGS. 6*a–c* are plan views of a wedge for cover in accordance with the present invention.
Figure 6B:
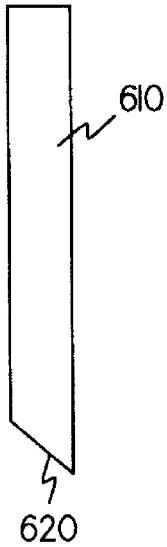
Figure 6C:
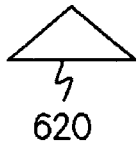

An example of a method for making a cover 50 having a mass density profile as just described begins with providing a base 400 as illustrated in FIG. 4, and affixing thereto substantially equally angularly placed foam wedges 600 radially positioned about central axis 420 as particularly illustrated in FIG. 5. Wedges 600 are more particularly illustrated in FIGS. 6*a*–*c* illustrating a top plan view, lateral side view, and end view respectively. Wedge 600 includes trapezoidal sides 610, inwardly leaning triangular end 620, rectangular base 630, and triangular end 640 (view not shown) perpendicular to base 630.

As illustrated in FIG. 5, the wedges 600 are aligned on base 400 such that the wedge edge 650 of each wedge 600 is aligned with line segments extending radially away from central axis 420, and that the triangular end 640 is close to the circumferential perimeter edge 415 of base 400. These wedges 600 may be held in place by a known adhesive. In turn, the assembly illustrated in FIG. 5 is then heated and compressed into a mold by way of an arbor press to form cover 50. The resulting compressed foam cover 50 resulting from the assembly as illustrated in FIG. 5 will have geometrical characteristics as already described with reference to FIGS. 2 and 3, but which will also have mass symmetry with a non-uniform mass profile about the central axis in a manner such that there exists higher mass radial portions of cover 50 that have a higher density than other portions thereof, and that are substantially equally angularly displaced about the central axis 420 thereof. While the example of FIG. 5 shows an embodiment having six wedges 600, the invention is not so limited. Useful embodiments may be constructed with as few as three such wedges or more than six.

Figure 9:
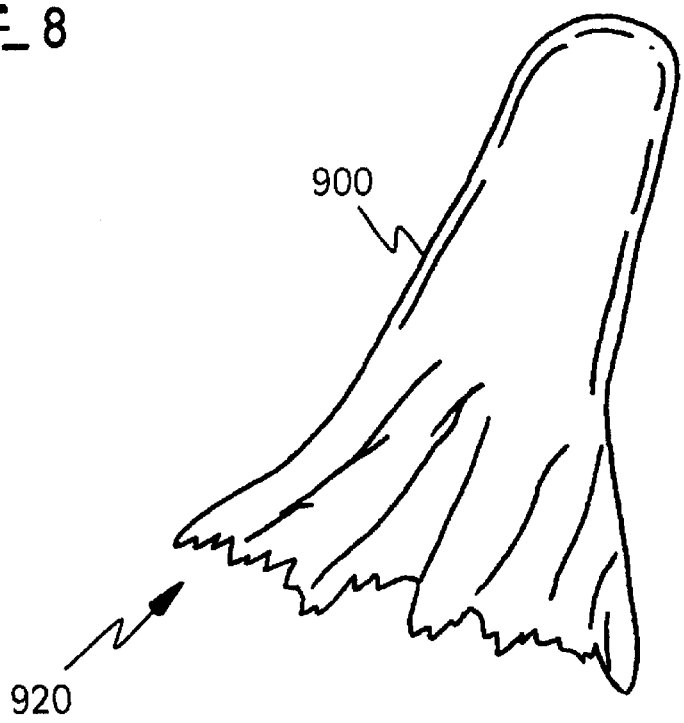
Fig. 9 (PRIOR ART)
FIG. 9 is an isometric sketch depicting an aerostable EFP projectile having passed through a shoot-through warhead cover of the prior art.

A cover 50 having a mass profile as just described beneficially affects the formation of a resultant EFP projectile so as to result in making substantially smooth uniform fin formations similar to those depicted in the sketch of an EFP projectile 800 as illustrated in FIG. 8. The resulting peripheral edges 820 of the aft section tend to be smooth, thereby providing a greater degree of aerodynamic stability. This may be readily contrasted with the rougher edges 920 as produce by projectiles 900 of the prior art as illustrated in FIG. 9.

As shown in FIG. 8, fin formations 810 are thought to be caused by the effect of the mass profile and mass symmetry of the cover as the initially formed EFP projectile passes through the low density cover. With cover 50 having six substantially equally angularly positioned radial mass portions as obtained by constructing the cover with six wedges as aforedescribed, experimentation has exhibited a projectile similar to that of FIG. 8 with several distinct fin formations 810. The number of wedges may be increased or decreased, and may more or less result in a similar number of projectile fin formations in proportion to the number of substantially equally angularly radial mass portions as the projectile passes through the cover.

Figure 7A:
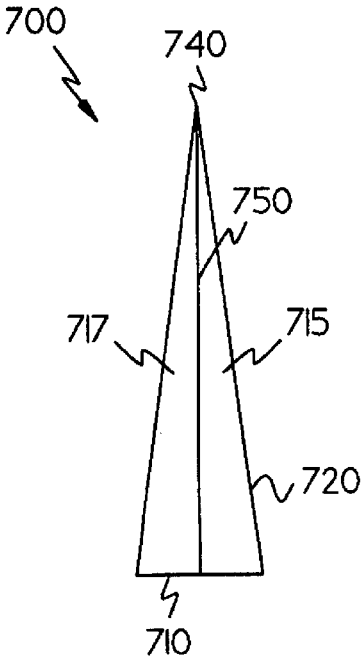
FIGS. 7*a–c* are plan views of another wedge.
Figure 7B:
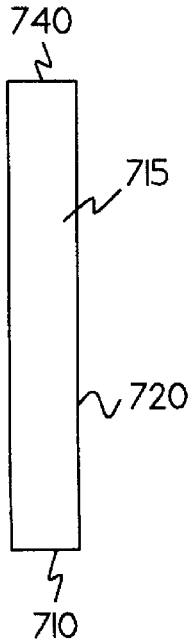
Figure 7C:
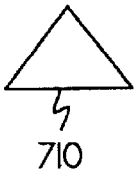

Illustrated in FIGS. 7*a*–*c* is an alternative wedge 700 structure that may be substituted for wedge 600. Wedge 700 includes a triangular end 710 perpendicular to a triangular base 720, and sides 715 and 717. One end of each of sides 715 and 717 forms a singular edge 740. Similarly to the structure shown in FIG. 5 (although not shown), a plurality of wedges 700 may be substantially equally angularly and radially aligned on a base 400 such that triangular end 710 is closest to the circumferential perimeter edge 415 of base 400.

As will be appreciated, a cover 50 constructed in a manner as already described, i.e., by heating and compressing, with one of a base 400 and either of wedge types 600 or 700, will exhibit a mass profile where the mass distribution is such that there exists higher mass density portions located radially away from the central axis 420 of base 400. The higher mass density portions are substantially equally angularly located about central axis 420. It is thought that this arrangement tends to enhance the formation of substantially equally angularly placed depressions in the resulting formation of the EFP projectile so as to produce a plurality of substantially equally angularly fin like formations in the resultant EFP projectile after exiting the shoot-through cover 50 in accordance with the present invention.

To dimensionally illustrate the aforesaid method in accordance with the present invention, a cover 50 was constructed using six (6) wedges 600 constructed similar to one shown in FIG. 6. Each wedge had a rectangular base 630 with dimensions of 0.77 by 2.38 inches, a triangular end perpendicular to the base with height of 0.39 inches, and a second inward leading triangular end 620 with the top edge 650 measuring 2.03 inches. The wedges were then symmetrically affixed in place by an adhesive on base 400 as illustrated in FIG. 5. In turn, the cover pre-form assembly was placed in a mold and heated. Afterwards, the mold was placed in an arbor press to compress the material and form the desired cover configuration as illustrated in FIGS. 2 and 3.

The method as just described requires employment of a low density material that may be formed by both heat and pressure such as polyethylene foam or the like. In the preferred embodiment of the present invention, cover 50 has been constructed of a low density material that is compressed in a mold to obtain the desired final form. A polymer foam such as polyethylene has been suggested as the starting material, but other known materials may be employed to achieve the improved EFP projectile characteristics of the invention, without the degradation of the projectile as heretofore observed with covers of the prior art. Further, it has been shown how the mass density of a cover may be altered so as to have a predetermined mass profile symmetrically about the central axis of the cover to enhance fin development of the EFP projectile.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

More specifically, there is a wide choice of low density materials that may be employed in the formation of cover 50 in accordance with the present invention. Further, a wide array of molding techniques may be utilized in order to make a warhead cover as particularly described and claimed herein. As will be appreciated by those skilled in the art having the benefit of this disclosure, the invention is not limited to those wedge configurations illustrated in FIGS. 6*a–c* and FIGS. 7*a–c* . Further still, the invention is not limited to a shoot-through cover that will enhance fin formation, but may be employed for projectiles of other aerodynamically stable shapes. Other equivalent configurations of various geometric shapes may be used to promote good fin formation.

What is claimed is:

1. A warhead delivery system, wherein a penetrator warhead is an explosively shaped projectile formed from a liner member, the warhead delivery system comprising:

a penetrator warhead including, a housing for containing an explosive charge, a liner member constructed to be formed into a projectile subsequent to detonation of said explosive charge and to exit said housing substantially along a reference launch axis, said liner member having an anterior surface in proximity to said explosive charge, and an opposite exterior surface;

a vehicle body for carrying said penetrator warhead, said vehicle body including, means for securing said penetrator warhead within said vehicle body, an exterior skin surface, and a projectile exit aperture through said exterior skin surface through which said projectile is to be launched therethrough; and a solid cover member consisting essentially of a polymer foam configured for mating relationship with said vehicle body aperture, said exterior skin surface and said exterior surface of said liner member, wherein said solid cover member has an exterior surface and an anterior surface and is constructed to have a non-uniform mass profile about a reference cover central axis passing through said exterior surface and said anterior surface and, said solid cover member is generally aligned with said reference launch axis, such that there exists a plurality of radial portions of said solid cover member having a higher mass density than other portions thereof, wherein the plurality of radial portions are substantially equally angularly displaced about said reference cover central axis so as to enhance formation of fins onto said explosively shaped projectile passing through said solid cover member.

2. The warhead delivery system of claim 1 wherein said polymer foam comprises polyethylene foam.

3. The warhead delivery system of claim 1 wherein said anterior surface of said solid cover member is in intimate contact with said exterior surface of said liner member.

4. The warhead delivery system of claim 3 wherein said polymer foam comprises polyethylene foam.

5. The warhead delivery system of claim 2 wherein said anterior surface of said solid cover member is in intimate contact with said exterior surface of said liner member.

6. The warhead delivery system of claim 1 wherein said plurality of radial portions include an even number of at least four radial portions of said solid cover member having a higher mass density than other portions thereof, wherein the even number of at least four radial portions are substantially equally angularly displaced about said reference cover central axis.

7. The warhead delivery system of claim 6 wherein said polymer foam comprises polyethylene foam.

8. The warhead delivery system of claim 6 wherein said anterior surface of said solid cover member is in intimate contact with said exterior surface of said liner member.

9. The warhead delivery system of claim 1 wherein said plurality of radial portions comprise a plurality of wedges.

10. A cover for a warhead delivery system, wherein a penetrator warhead is an explosively formed penetrator warhead in which a projectile is explosively formed from a liner member initially contained within a housing having an explosive charge therein, wherein the liner member has a liner member exterior surface, and wherein said liner member is formed into a projectile subsequent to detonation of said explosive charge for passing through an aperture through an exterior skin surface of a vehicle body carrying said explosively formed penetrator warhead, said cover comprising:

a solid cover member consisting essentially of a polymer foam configured for a mating relationship with said vehicle body aperture, said exterior skin surface and said liner member exterior surface, wherein said solid cover member has an exterior surface and an anterior surface and is constructed to have a non-uniform mass profile about a reference cover central axis passing through said exterior surface and said anterior surface and, said solid cover member is generally aligned with said reference launch axis, such that there exists a plurality of radial portions of said solid cover member having a higher mass density than other portions thereof, wherein the plurality of radial portions are substantially equally angularly displaced about said reference cover central axis so as to enhance formation of fins onto said explosively shaped projectile passing through said solid cover member.

11. The cover of claim 10 wherein said polymer foam comprises polyethylene foam.

12. The cover of claim 10 wherein said solid cover member anterior surface is configured so as to be in intimate contact with said liner member exterior surface.

13. The cover of claim 12 wherein said polymer foam comprises polyethylene foam.

14. The cover of claim 11 wherein said solid cover member anterior surface is in intimate contact with said exterior surface of said liner member.

15. The cover of claim 10 wherein said plurality of radial portions include an even number of at least four radial portions of said solid cover member having a higher mass density than other portions thereof, wherein the even number of at least four radial portions are substantially equally angularly displaced about said reference cover central axis.

16. The cover of claim 15 wherein said polymer foam comprises polyethylene foam.

17. The cover of claim 15 wherein said solid cover member anterior surface is in intimate contact with said liner member exterior surface.

18. The cover of claim 16 wherein said solid cover member anterior surface is in intimate contact with said liner member exterior surface.

19. The cover of claim 10 wherein said plurality of radial portions comprise a plurality of wedges.

* * * * *

UNITED STATES PATENT AND TRADEMARK OFFICE

CERTIFICATE OF CORRECTION

PATENT NO. : 5,925,845

DATED : Jul. 20, 1999

INVENTOR(S) : Tompkins et al.

It is certified that error appears in the above-identified patent and that said Letters Patent is hereby corrected as shown below:

Col. 3, line 39, "masssymmetry" should be replaced with -- mass-symmetry--

Signed and Sealed this

Twenty-fifth Day of January, 2000

*Attest:*

*Attesting Officer*

*Acting Commissioner of Patents and Trademarks*